United States Patent [19]

Steeg et al.

[11] 4,050,223

[45] Sept. 27, 1977

[54] DEVICE FOR UNPACKING BOTTLES OR SIMILAR ARTICLES IN A SHRINK FOIL PACKAGE

[75] Inventors: Emil Steeg, Budenheim; Uwe Hoffmeyer, Mainz, both of Germany

[73] Assignee: Automation Steeg and Hoffmeyer GmbH, Budenheim, Germany

[21] Appl. No.: 692,761

[22] Filed: June 4, 1976

[30] Foreign Application Priority Data

June 4, 1975 Germany ..... 7604334[U]

[51] Int. Cl.[2] ..... B65B 69/00

[52] U.S. Cl. ..... 53/381 R

[58] Field of Search ..... 53/381 R; 214/305

[56] References Cited

U.S. PATENT DOCUMENTS 3,889,442 6/1975 Grahn et al. ..... 53/381 R X 3,922,778 12/1975 Aalpoel ..... 53/381 R X

*Primary Examiner*—Travis S. McGehee

*Attorney, Agent, or Firm*—Gifford, Chandler, Sheridan & Sprinkle

[57] ABSTRACT

A table is adapted to receive the shrunk foil package, and its top is substantially the same in size or somewhat smaller than the base surface of the package. A pressing platen is adapted to be lowered on to the package, for clamping and holding firm the bottles. A cutting device cuts open the shrunk foil around the periphery of the package. A gripping device folds downwards the edge, produced by cutting open, of the lower shrunk foil part, over the table top. A frame can be fitted over the platen and the package holds together the bottles after moving the platen clear of them and with which the bottles can be pushed off the lower part of the shrunk foil.

6 Claims, 9 Drawing Figures

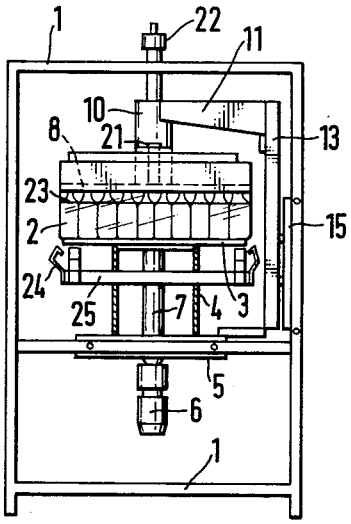
FIG. 1
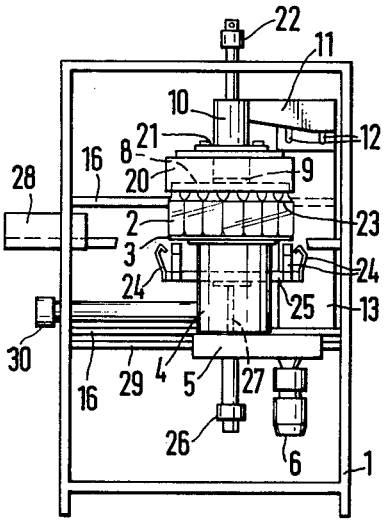
FIG. 2
FIG. 3
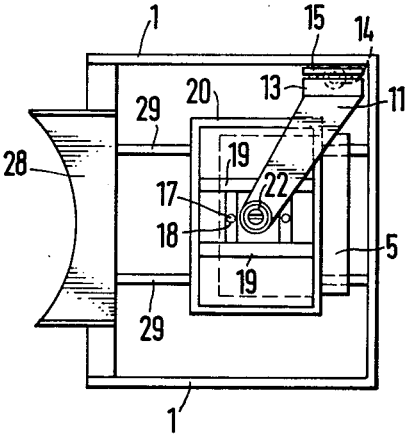

DEVICE FOR UNPACKING BOTTLES OR SIMILAR ARTICLES IN A SHRINK FOIL PACKAGE

BACKGROUND OF THE INVENTION

1. Field to which Invention Relates

The invention relates to a device for unpacking bottles or similar articles in a shrink foil package.

2. The Prior Art

Small bottles, more particularly bottles for medicaments are packaged by the glass manufacturer for transport to the consumer, that is to say medicament manufacturers and bottling undertakings, frequently using shrinking foils in the form of flat packages or trays. The bottles are then in a closely packed layer and are surrounded on all sides by the shrinkage foil, which presses them together. Such a package can easily be handled. For medicament bottles it is furthermore important that the bottles, which are sterile owing to the high temperature to which the glass is subjected on manufacture, and which as yet do not have any closure, are packaged in a hermetical manner.

SUMMARY OF THE INVENTION

On the premises of the consumer the packages must be opened. In this respect owing to the high speeds of filling it is necessary for the opening of the packages and ordered release of the bottles to occupy a short amount of time and it should proceed automatically. Furthermore the penetration of dirt into the bottles should be avoided.

A first embodiment of the invention intended to fulfil this task is characterized by a table adapted to receive the shrunk foil package, whose table top is substantially the same in size or somewhat smaller than the base surface of the package, a pressing platen, adapted to be lowered on to the package, for clamping and holding firm the bottles, a cutting device for cutting open the shrunk foil around the periphery of the package, a gripping device, which folds downwardly the edge, of the lower shrunk foil part produced by cutting open, downwardly, over the table top, a frame which can be fitted over the platen and the package, which holds together the bottles after moving the platen clear of them and with which the bottles can be pushed off the lower part of the shrunk foil.

The whole bottle package is thus clamped firmly between the table and the pressing platen so that the shrunk foil can be cut open along and around the package edge without the bottles toppling over or being displaced. The cutting open is preferably carried out a short distance above the shoulders of the bottles so that the shrunk foil is severed to produce an upper lid part with a narrow edge or rim and a lower bottom part with a comparatively high rim. This high rim projects to the outside and can then be drawn downwards by means of the gripping device over the edges of the table top. Accordingly the bottles are freed at the lower side and can be pushed off the shrunk foil and accordingly from the table, for example on to a bottle bulk receiving device in the form of a turntable. Since the bottles are covered during the whole operation by the upper part of the shrunk foil, it is possible to ensure that no dirt falls into the bottles. Toppling over of the bottles in the apparatus in accordance with the invention is avoided by the frame fitted over the platen and the package, which holds together the bottles after they have been released by the pressing platen.

In accordance with a further feature of the invention there is the possibility of constructing the table as a mechanically driven turntable. In this case the cutting device does not need to be moved around the package. The turntable can conveniently be adapted to be moved pneumatically or hydraulically. Furthermore it is conveniently provided in the edge part with a cushioning layer in order to hold all bottles securely notwithstanding tolerances in height.

In order to remove the upper shrunk foil part the pressing platen can be provided with openings connected with a suction line, which, after the pressing platen has cleared the bottles, hold the shrunk foil in position so that the bottles can then be pushed out under the foil.

In accordance with a further development of the invention the gripping device comprises a vertically sliding carrier which is arranged underneath the table and which has arranged on it several gripping clamps for engaging the lower shrunk foil part at the edge of the latter. Accordingly the edge or rim of the shrunk foil part can be drawn downwards reliably and automatically over the edge of the table.

The frame and the pressing platen are conveniently fixed in a rotary manner on a vertically adjustable boom, which is carried in the frame of the apparatus so that it can perform a horizontal sliding movement.

A second embodiment of the invention constructed to attain the aim of the invention is characterised by a table adapted to receive the shrunk foil package, with a stationary table top, a turntable and a lifting table, which can be raised and lowered in order to form a receiving niche, in relation to the table top and the turntable, a cutting device for cutting open the shrunk foil along the periphery of the package, a gripping device, which after detaching by cutting the covering foil can be moved from the side to a position adjacent to the rim or edge of the shrunk foil and on lifting the lifting table strips off the rim, produced by cutting open, of the boxshaped lower part, and a frame adapted to surround the package, which holds the bottles together and can be displaced with the latter from the lower part of the shrunk foil.

In this manner the device can easily be adapted for semi-automatic or fully automatic operation and the shrunk foil package, owing to the provision of the niche, is reliably held on cutting open the covering foil without a pressing platen being necessary for gripping and holding the bottles. The gripping device can be adapted in a satisfactory manner to the respective requirements of the particular shrunk foil used.

LIST OF SEVERAL VIEWS OF DRAWINGS

In what follows embodiments of the invention will be described with reference to the accompanying drawings.

FIGS. 1, 2 and 3 show a front view, a side view and a plan view of an embodiment constituting the first form of the invention.

DESCRIPTION OF PREFERRED EMBODIMENTS

Figure 4:
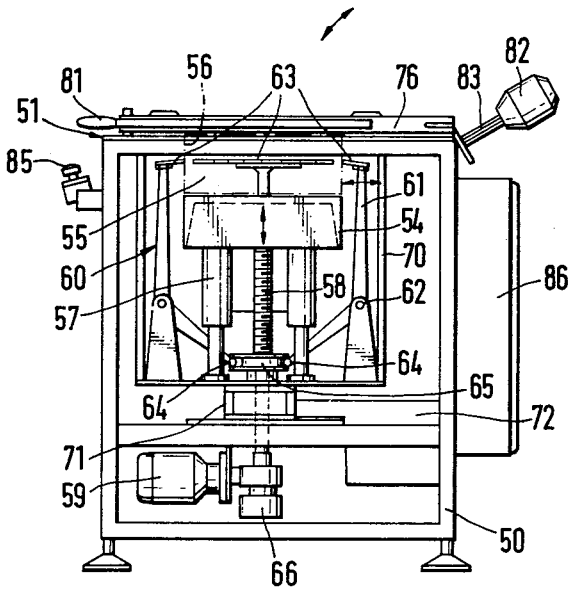
FIGS. 4 and 5 show a side view and a plan view of the embodiment in accordance with the second form of the invention.

The unpacking device in accordance with FIGS. 1 to 3 is accommodated in a frame 1, consisting for example of angle girders. The bottle package 2, having a shrunk foil, rests on a table top 3, which is mounted in a rotary fashion on a hollow cylinder 4. The hollow cylinder is attached to a gear housing 5 with a flanged on geared motor 6. Through the hollow cylinder 4 there extends a drive shaft 7 for the table top 3, which in this manner can be caused to rotate by means of the geared motor 6 and, for example, a belt drive in the gearing housing 5.

For clamping fast the bottle package 2 use is made of a pressure platen 8, which is connected by means of a bearing indicated by reference numeral 9 with a tube 10. The tube is mounted on a boom 11, which is attached in a vertically adjustable manner on a carrier 13 by means of a device 12, which is only shown diagrammatically. For pressing into position and releasing respectively the pressing platen 8 the carrier 13 can be moved by means of a lifting cylinder 14, indicated in FIG. 3, vertically with respect to a sliding plate 15 provided with corresponding guides. The sliding plate 15 itself is in turn capable of sliding horizontally in guide rails 16.

The pressing platen 8 is provided with two guide pins or studs 17, which slide in corresponding holes 18 of struts 19 of a frame 20 and make possible a vertical movement of the frame 20 limited by an abutment 21. This relative displacement between the frame 20 and the pressing plate 8 is vertically adjustment by a hydraulic cylinder 22, which is fixed in the tube 10 and whose piston rod (not shown) engages the frame 20.

For unpacking the bottles the package is mounted on the table top 3. The carrier 13 and accordingly the boom 11, the tube 10 and the pressing platen 8 have already been moved by means of the cylinder 14 into the highest position and simultaneously the hydraulic cylinder 22 will have brought the frame 20 into the highest position so that there is sufficient space for placing the bottle package 2 in position. The device 12 for vertical adjustment makes possible in this respect an adaptation to different heights of bottles. For clamping the bottles in position the pressing platen 8 is pressed by means of the cylinder 14 on to the bottles and for compensation of tolerances and improving the clamping action the lower side of the pressing platen 8 is provided with an elastic coating.

By means of a switch or also by means of automatic sequential operation the drive motor is started so that the table top 3 together with the bottle package 2 and the pressing platen 8 together with the frame 20 and its associated assemblies is caused to rotate. It is then possible by means of a cutting device, which is not shown, and which in the simplest case is a knife held in position by the operator, the shrunk foil can be cut open along the line 23 just above the shoulders of the bottles along and around the whole periphery of the package 2. Owing to the tension of the shrunk foil the edge of the shrunk foil part produced below by the cutting action, projects laterally so that it can be engaged by gripping clamps 24 provided with barbs. The clamps 24 are attached to a carrier 25 and can be moved upwards and downwards by means of a hydraulic cylinder 26 and its piston rod 27. When the gripping clamps 24 have engaged the shrunk foil, they are drawn downwards so that the shrunk foil is drawn downwards or folded downwards over the table top 3.

For complete unpacking the bottles must now be pushed off the table top 3 with removal of the top shrunk foil part. For this purpose the whole bottle carrying and holding device is displaced towards a transfer table 28. The drive housing 5 with the parts fixed to it then slides in rails 29. The shifting movement is again produced with the help of a further hydraulic cylinder 30. Previously the frame 20 has been lowered by means of the cylinder 22 over the bottle package 2 and the pressing platen 8 has been raised slightly. When the table top 3 comes into engagement then with the transfer table 28, by bringing about further shifting of the carrier 13 and accordingly of the pressing platen 8 and the frame 20, the bottle package 2, being entrained by frame 20, is pushed to the frame 20, on to the transfer table where it can then be accepted, for example, by a turntable, which is adapted to the circular recess in the transfer table 28. When the shifting movement takes place the bottles cannot topple over because the frame 20 restricts their possibility of horizontal movement and pivoting into a slanting position is not possible owing to the only slight raising of the pressing platen 8.

It is only after complete pushing off of the bottle package 2 that the pressing platen 8 and the frame 20 are moved upwards, releasing the bottle package, by means of the hydraulic cylinders 14 and 22, and in this respect openings (not shown) connected with a vacuum line, in the pressing platen 8 hold fast the upper part of the shrunk foil so that the bottles are now completely unpacked. In this respect it is important that the bottle openings are held covered as long as possible by the upper part of the shrinkage foil so that contamination of the interior of the bottles is avoided. After the return movement of the whole unit and the removal of the shrunk foil parts a new operation can be commenced.

Adaptation of the device to suit different bottle and package sizes is readily possible. It is only necessary to replace the table top 3, the pressing platen 8 and the frame 20 together with the carrier 25 with the clamps 24. Preferably the parts mentioned are provided for this replacement with quick release attachment devices which can easily be operated. For adaptation of the frame size there is also the possibility of using, in lieu of the close frame 20, four separate frame parts, whose spacing from each other can be adjusted for adaptation to the basic surface of the bottle packages.

Figure 5:
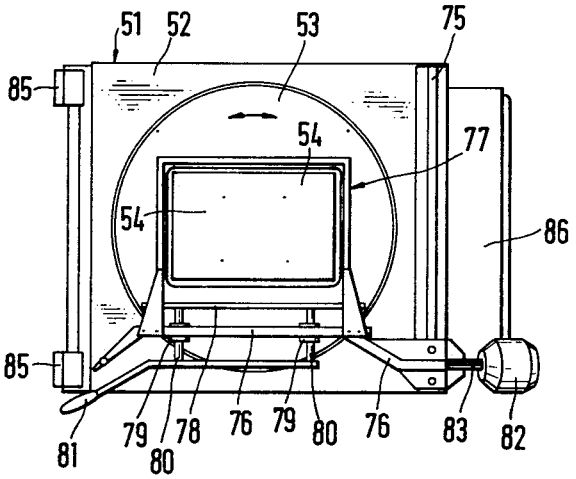

In the case of the embodiment of the invention as shown in FIGS. 4 and 5 a machine frame 50 has on its upper side a table 51, which consists of three parts, that is to say a stationary table top 52, a turntable 53 and the upper side of a lifting table 54. In accordance with the particular setting of the lifting table 54 the surfaces of the parts 52, 53 and 54 can be made to lie in a single plane, or a trough 55 is formed, which can receive a shrunk foil package 56, when the lifting table 54 is lowered. The lifting table has telescoping guides 57 and a lifting spindle or lead screw 58, which can be driven by a motor 59. To the side of the lifting table 54 there is a gripping device 60, which has four gripping arms 61, which are opposite each other in pairs. The gripping arms 61 are constructed as bell cranks, whose pivot axis is denoted by reference numeral 62. The other end of each gripping arm 61 has a stripping rail 63 which is in the position to engage the box-shaped edge of a cut open shrunk foil package 56 and to strip it off from the content of the package. The lower end 64 of each gripping arm 61 is constructed as a joint pin and rests in a groove in a sliding coupler 65, which can be moved upwards and downwards by means of a thrust motor 66 (hydraulic cylinder, compressed air cylinder) and owing to the coupling entrainment at the positions 64 the gripping arms 61 are spread apart before the reception of a shrunk foil package 56 and then close again in order to strip off the foil after the latter has been cut open.

The parts 54, 57, 60, 61, 62, 63 and 64 are connected with the turntable 53 via a turntable frame 70, which has a cage-like construction and is journalled by means of a bearing 71 on the machine frame 50. The turntable frame 70 can be turned through one full rotation by means of an indexing device 72, which is diagrammatically indicated in FIG. 4. Owing to the turntable 53 performing one full rotation the covering foil of the shrunk foil package 56 can be cut off from the remaining part by holding a knife at the edge of the shrunk foil package.

At the rim of the table 51 there is a shaft 75, on which an arm 76 is journalled for pivoting movement and it can also be moved in the longitudinal direction. The arm 76 carries a frame 77, of which three sides are fixed and one side 78 is arranged for shifting movement. For this purpose the arm 76 has two sliding bearings 79, which serve for receiving one respective thrust rod 80 and these thrust rods are connected on the one hand with the frame side 78 and on the other hand with a gripping arm 81. Material located in the frame 77 can in this manner be pressed together to a greater or lesser extent by means of the frame side 78 and accordingly the articles arranged in this foil can be held together. A counter-weight 82 serves to balance the weight of the frame 77 so that the frame can be folded upwards without immediately dropping back on to the table 51. For this purpose the lever arm 83, on which the counter-weight 82 is mounted, is arranged at an angle to the arm 76, as can be seen from FIG. 4. This construction offers also the advantage that the frame 77 remains on the table 51, since in this position the effective lever length of the arm 83 is shortened.

On the operator side of the device there are two switch groups 85, which may have to be operated with both hands in order to switch on the various different functions. In a control cupboard 86 various control circuits are accommodated as are required for the following course of operations.

Figure 6:
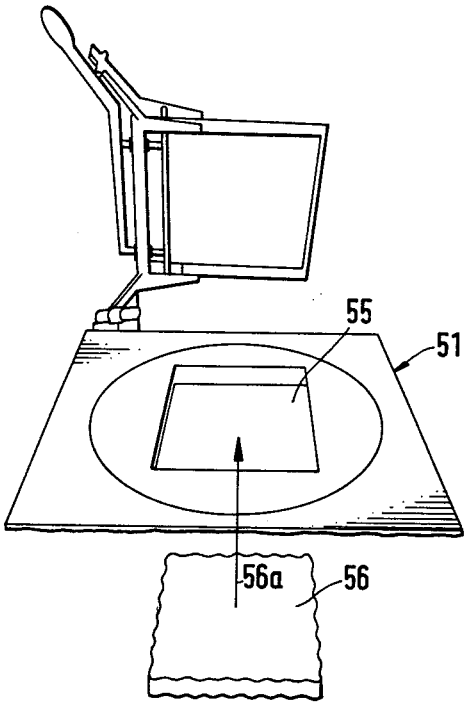
FIGS. 6 to 9 show individual phases on unpacking bottles using the embodiment of the invention in accordance with FIGS. 4 and 5.
Figure 7:
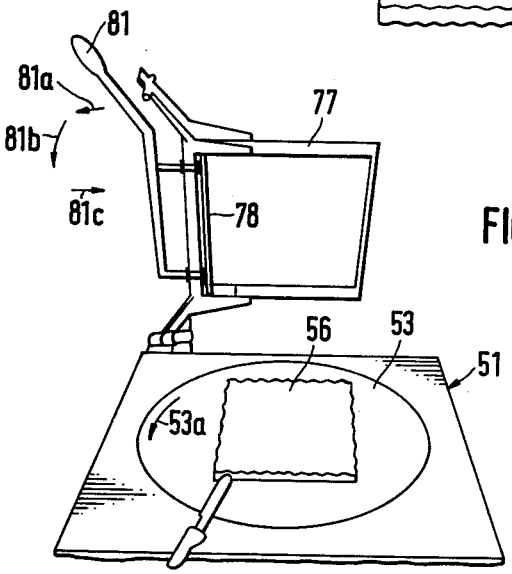
Figure 8:
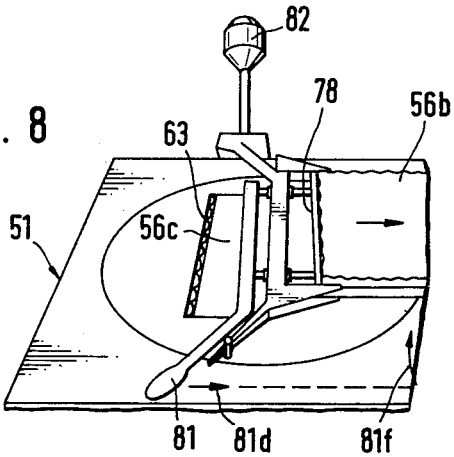
Figure 9:
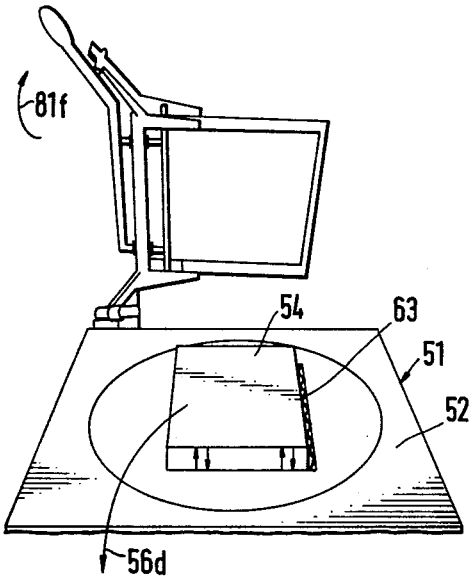

While the frame 77 is held pivoted upwards by means of the gripping arm 81, either manually or automatically a shrunk foil package 56 is moved on to the table 51 (**56*a*, FIG. 6) and comes into the niche 55, which is produced by lowering the lifting table 54. Now a knife represented in FIG. 7 is held against the upper edge of the shrunk foil package 56 either by hand or by means of an automatic device, and the turntable 53 is turned by means of the indexing device 72 for at least one full rotation or possibly 1.5 or 2 rotations 53*a* so that the knife cuts through the covering foil 56*b* in FIG. 8 of the shrunk foil package and in the niche 55 a box-shaped piece of foil 56*c* remains. See FIG. 8**.

The gripping arms 61 are now swung in the manner of tongs by actuation of the thrust motor 66 so that the gripping rails 63 come into a position adjacent to the edge of the box-shaped part **56*c* of the shrunk foil package 56. Furthermore the lifting motor 59 is now started, which moves the lifting table 54 upwards by means of the lead screw so that owing to the relative movement between the gripping rails 63** and the edge of the foil package the stripping movement is performed, by means of which the articles (bottles) are cleared of the remaining foil.

In the third operational phase the frame 77 is swung on to the exposed articles **81*a*, 81*b* by pressing 81*c* of the gripping arm 81 so that the articles are held in position by the pressing action of the frame side 78. By shifting 81*d*, FIG. 8 of the gripping arm 81 the bearing eye of the arm 76 slides along the shaft 75 (see FIG. 5), that is to say the frame 77 moves together with its contents (exposed articles) on to the table 51 and can be placed on a further conveying device, which is not shown, following which by means of actuation 81*f* of the gripping arm 81 both the frame side 78 is released and by folding up the frame 77 it is removed from the articles. In accordance with particular requirements the cut off covering foil 56*a*** is left on the articles or it can be removed.

In order to remove the remaining foil part **56*c* from the device the lifting table 54 is moved for a small distance upwards so that the gripping rails 63 come to lie underneath the box-shaped remaining foil part 56*c*. Following this the lifting table 54 is moved again so as to be level with the table top 52 so that the remaining foil 56*c* can be stripped off and can readily be removed by hand or mechanically, 56*d***.

After lowering the lifting table 54 a niche 55 is again formed (FIG. 6) and the next shrunk foil package can be opened as described above.

The particular advantage of the new device for unpacking articles resides in that the temporarily formed niche 55 represents the means for holding fast the shrunk foil package 56 when its covering foil **56*b* is cut away or removed. The movements of the table 54 do not in this respect serve to form this niche 55 only but they also serve to remove the encompassing foil part 56*c* from the articles and finally also from the lifting table 54, the gripping rails 63 cooperating in each case. The rim of the gripping rails 63** can furthermore be adapted to the shape of the articles to be unpacked, for example a number of semicircular recesses can be provided in the edge.

In order to adapt the device for automatic operation it is for example possible to provide a knife arm which can be lowered, which in the lowered condition does not impede the supply of shrunk foil packages. The movements of the frame 77 can readily be merchanized. A modified construction of this frame is possible in that it opens laterally for receiving the shrunk foil package and closes again without the folding up movements shown having to be carried out. If furthermore the frame is to be caused to perform two removal movements it will be possible to bring, on carrying out the first movement, the articles on to a conveyer track and to remove the remaining foil part from the table 51.

We claim:

1. A device for unpacking bottles or similar articles in a shrunk foil package, characterized by a table adapted to receive the shrunk foil package, with a stationary table top, a turntable and a lifting table which can be raised and lowered in relation to the table top and the turntable in order to form a receiving niche, a cutting device for cutting open the shrunk foil along the periphery of the package, a gripping device, which after the foil covering has been cut can be moved from the side to a position adjacent to the rim or edge of the box-shaped lower part of the shrunk foil produced by the cutting and on lifting the lifting table strips off the rim, and a frame adapted to surround the package, which holds the bottles together and can be displaced with the latter from the lower part of the shrunk foil.

2. A device in accordance with claim 1 characterized in that the frames surrounding the bottles can be pivoted around a shaft which is mounted on the table to facilitate shifting movement of the frame along the table.

3. A device in accordance with claim 2, characterized in that the frame is provided with a counter-weight.

4. A device in accordance with claim 2, characterized in that the frame has a gripping side.

5. A device in accordance with claim 4, characterized in that the gripping side is adapted to be moved into engagement against the bottles by means of a gripping arm.

6. A device in accordance with claim 5, characterized in that the gripping arm is constructed simultaneous for pivoting and shifting of the frame.

* * * * *

UNITED STATES PATENT AND TRADEMARK OFFICE

CERTIFICATE OF CORRECTION

PATENT NO. : 4,050,223

DATED : September 27, 1977

INVENTOR(S) : Emil Steeg & Uwe Hoffmeyer

It is certified that error appears in the above-identified patent and that said Letters Patent are hereby corrected as shown below:

Col. 1, line 42, delete "downwardly", same line, after "edge", insert --downwardly--.

Col. 3, line 31, delete "adjustment", insert --adjusted--.

Col. 6, line 16, delete "56a", insert --56b--;

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*